United States Patent [19]

Marchiselli

[11] 4,024,735

[45] May 24, 1977

[54] WASHING MACHINE

[75] Inventor: Sergio Marchiselli, Barcelona, Spain

[73] Assignee: Zallas Establishment, Eschen, Liechtenstein

[22] Filed: Nov. 28, 1975

[21] Appl. No.: 636,145

[30] Foreign Application Priority Data

Nov. 30, 1974 Spain ..... 432739

[52] U.S. Cl. ..... 68/16; 34/133; 68/20; 68/139

[51] Int. Cl.² ..... D06F 21/04; D06F 39/04; D06F 25/00

[58] Field of Search ..... 68/16, 19.2, 20, 139; 34/133

[56] References Cited

UNITED STATES PATENTS

| | | | |
|---|---|---|---|
| 1,799,649 | 4/1931 | Schenck | 68/19.2 |
| 2,875,526 | 3/1959 | Engel et al. | 68/20 X |
| 2,975,623 | 3/1961 | Eichhorn et al. | 68/20 X |
| 3,114,653 | 12/1963 | Kruzan | 34/133 X |
| 3,167,409 | 1/1965 | Brucken | 34/133 |
| 3,868,835 | 3/1975 | Todd-Reeve | 68/20 |

*Primary Examiner*—Philip R. Coe

[57] ABSTRACT

A clothes-washing machine comparable to those of the automatic type, which incorporates a device for the formation and circulation of an induced airflow in order to effectuate the drying of clothes which are present in the drum of the machine. The device comprises a single resistor for carrying out the functions of heating the washing water and heating the air for drying, so as to result in a simplification in the structure and composition of the machine. Similarly, a motor which actuates a turbine for producing the induced flow of drying air is the same motor which, at the appropriate operating stage drives the water-circulating pump, also in this manner, to simplify the structure of the machine.

9 Claims, 4 Drawing Figures

WASHING MACHINE

FIELD OF THE INVENTION

The present invention relates to improvements in a clotheswashing machine comparable to those of the automatic type, which incorporates a device for the formation and circulation of an induced airflow in order to effectuate the drying of clothes which are present in the drum of the machine. The utilization of the inventive device imparts to the washing machine important functional advantages as expounded hereinbelow in enlarged detail.

SUMMARY OF THE INVENTION

The invention involves the generation of an induced airflow, heating this airflow by means of a resistor and directing this airflow interiorly of the drum of the machine containing the clothes, while concurrently arranging for the outflow and discharge of the air from the drum. The drying cycle, of course, takes place after completion of the phases of washing, rinsing and spinning of the clothes, so that the clothes will be already perfectly dry when taken out of the machine.

Another important advantage of the employment of the inventive device lies in the utilization of a single resistor for carrying out the functions of heating the washing water and heating the air for drying, so as to result in a simplification in the structure and composition of the machine. Similarly, a motor which actuates a turbine for producing the induced flow of drying air is the same motor which, at the appropriate operating stage drives the water-circulating pump, so as, in this manner, to simplify the structure of the machine.

As a result of the two types of machine simplification mentioned hereinabove, there is afforded a considerable reduction in the manufacturing cost of the washing machine, as well as in the consumption of electrical energy by the machine, this being of great importance from the economic and commercial point of view.

A further advantage of the invention is that the hot air circuit is strictly confined to the parts necessary for its functioning, whereby the hot airflow will not contact parts or areas which do not belong to its required circuit, as it does in other types of washing machines, wherein the hot air produced in a given area of the body of the machine has to circulate through non-working areas and thereby heat them unnecessarily, for example, the area around the loading door of the machine.

Hence, according to the invention there is a considerable rationalization or improvement in the design and operation of the washing machine, a simplification of its structure, and a marked reduction in the electrical energy which it will consume.

BRIEF DESCRIPTION OF THE DRAWINGS

Reference may now be had to the following detailed description, taken in conjunction with the accompanying drawings showing by way of illustration a practical example of the improved inventive washing machine, in which.

DETAILED DESCRIPTION

Figure 1:
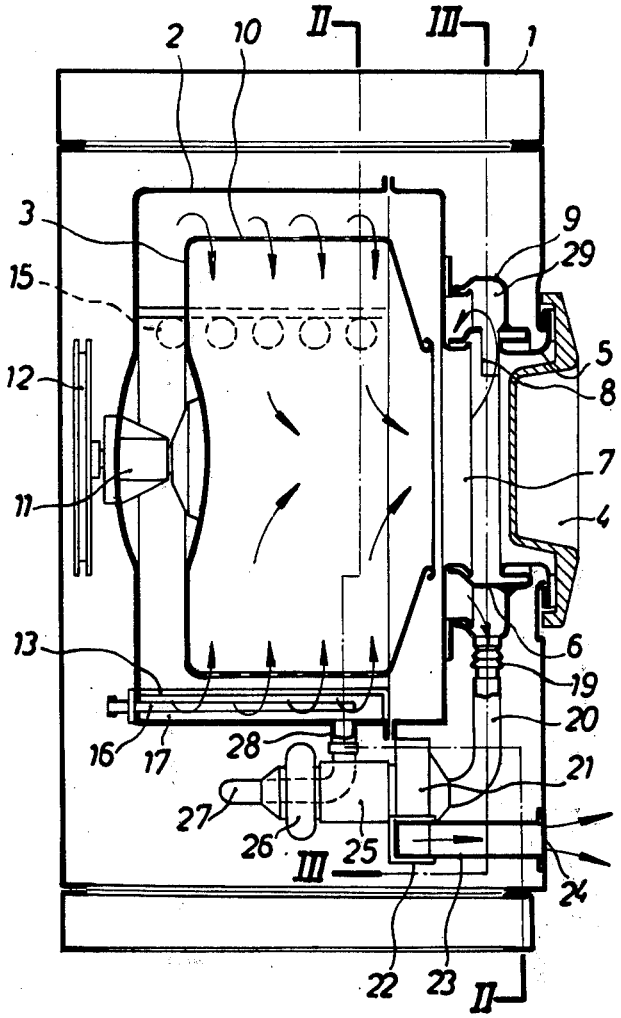
FIG. 1 is a side elevational view, in section, of a clothes-washing machine according to the present invention.
Figure 2:
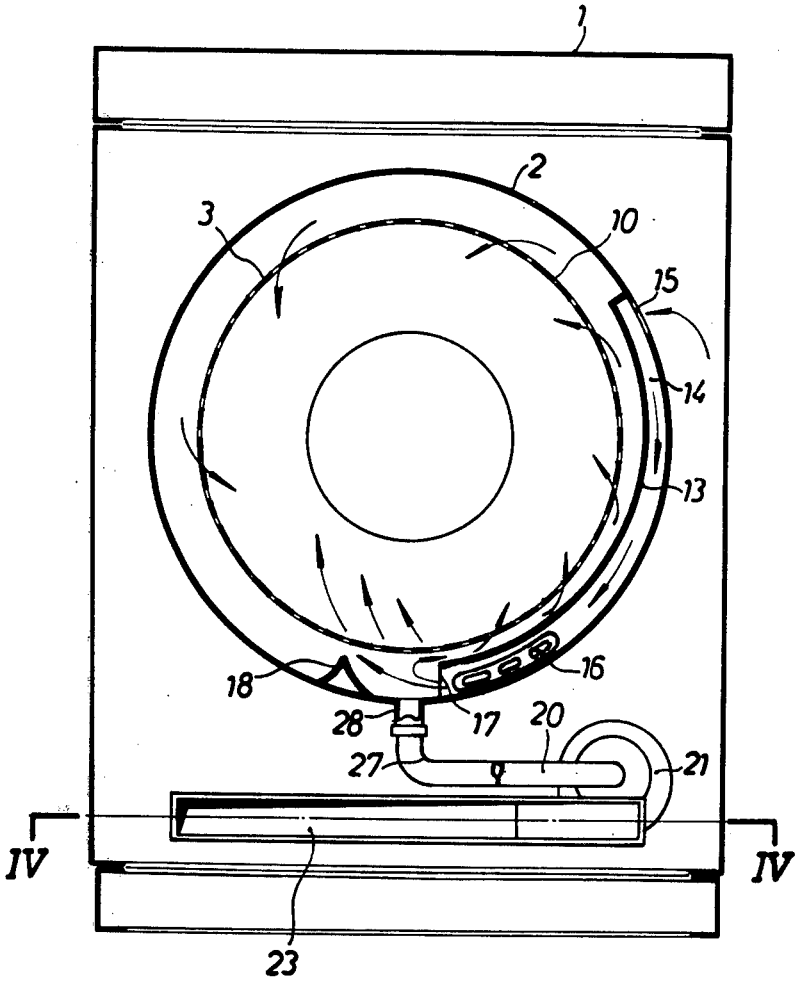
FIG. 2 is a sectional view taken along line II—II in FIG. 1.
Figure 3:
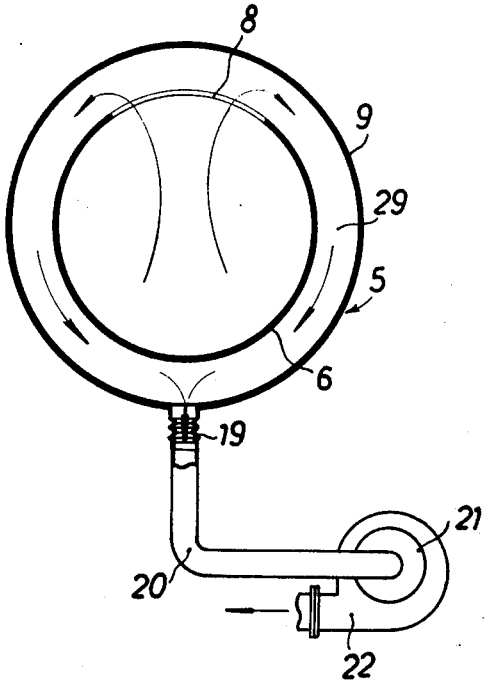
FIG. 3 is a sectional view taken along line III—III in FIG. 1.
Figure 4:
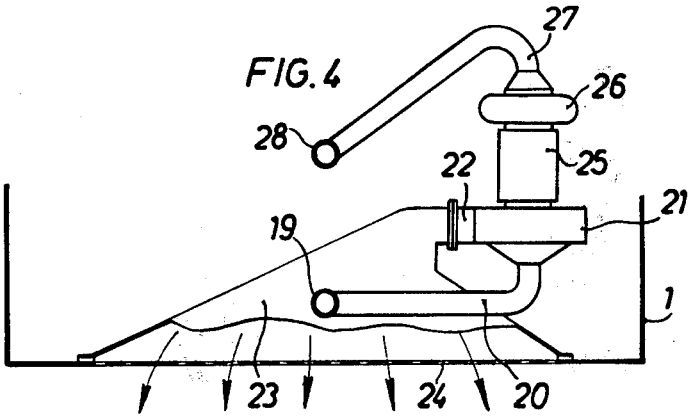
FIG. 4 is a sectional view taken along line IV—IV in FIG. 2.

A metal casing or frame 1 encompasses the machine, housing and protecting the internal parts of the latter, which parts include a fixed drum 2 of cylindrical shape extending about a horizontal axis, and within which there is located a coaxial rotatable drum 3. A loading door 4 is provided for access to the inside of the machine, specifically for insertion and removal of the clothes, the machine having a specially-shaped joint 5 shown in vertical section in FIG. 1 in the form of an S-shaped hollow member formed in part by the door frame with an extenstion 6 connected to the fixed drum around opening 7 in the fixed drum 2. An opening 8 is formed in the s-shaped member through which drawn off air will pass through the area 9 of greatest diameter of the joint, forming with the internal area or extension 6 a circular air-extraction chamber. Inlets 10 are formed in the cylindrical walls of the rotatable drum 3. A rotary suspension device 11 is provided for the moving drum, to which device 11 there is attached pulley 12, which drives the device by means of a motor. A curved metal plate 13 which is non-parallel to drum 2 is fitted inside the fixed drum 2 and forms, with the drum, a chamber 14 within the space between the two coaxial cylindrical drums 2 and 3. Inlets 15 are provided at the top of the chamber 14, through which inlets air enters the chamber. A set of resistors 16 is positioned inside the chamber 14 fitted to the bottom of the fixed drum 2 so that when the washing water is in the drum, the resistors will be submerged in the water. A prism-shaped projection 18 of triangular section is located opposite the outlet 17 of the chamber 14 and acts as a deflector of the airstream which has entered through the inlets 15 and flows in the direction of the arrows through the chamber, the air being diverted by the deflector through the inlets 10 into the rotatable drum or tumbler 3.

An extraction outlet 19 is provided for the air contained in the space 29 between the two coaxial circular walls of the joint 5 flowing out from within the tumbler 3, with a ducting 20 connecting the outlet 19 with the intake of an extractor turbine 21, whose air exhaust 22 connects up with the chamber 23 through which the expelled air escapes via a grill 24 positioned in the front face of the frame 1 of the machine.

An electric motor 25 drives the extractor 21 and a water-drainage pump 26, the water passing out through a pipe 27 which is connected to a bottom outlet 28 provided in the fixed drum 2.

The path followed by the air is, therefore, as follows: from within the frame 1 the air enters through the inlets 15, flows through the chamber 14, being heated as it passes over the resistors 16; then the air enters the rotatable drum or tumbler 3 through the inlets 10, dries the clothes therein by absorbing the moisture therefrom, passes into the circular space 29 formed by the joint 5, is then drawn out through the ducting 20 and the turbine 21, and finally is expelled through the exhaust 22 into the chamber 23 leading to the outside of the frame.

While there has been shown what is considered to be the preferred embodiment of the invention, it will be obvious that modifications may be made which come within the scope of the disclosure of the specification.

What is claimed is:

1. A clothes-washing machine comprising a casing, a fixed cylindrical component in said casing, a rotatable drum mounted coaxially within said fixed cylindrical component and forming a space therewith, said rotatable drum having a wall with apertures therein, said rotatable drum being adapted to receive clothes to be washed, a curved plate secured to said fixed component in the space between said drum and said fixed component, said curved plate extending non-parallel to said fixed component and defining a chamber therewith having an upper inlet provided by an aperture formed in the cylindrical component for admission of air thereinto and a lower outlet which opens into the space between the drum and the fixed component, a set of heating resistors located in said chamber proximate said lower outlet, and a prism-shaped piece of triangular section forming a deflector mounted on said fixed component in the space between said drum and said fixed component and opposite and adjacent said outlet of the chamber for diverting air discharged from said outlet so that said air enters the rotating drum through said apertures in its wall.

2. A machine as claimed in claim 1 wherein said curved plate extends over a portion of the periphery of the fixed cylindrical component.

3. A machine as claimed in claim 2 wherein said chamber widens in a direction from the inlet to the outlet.

4. A machine as claimed in claim 1 comprising a loading door, a hollow connection member including a door frame, said hollow connection member being secured to said fixed component, said fixed component and said rotatable drum having access openings through which clothes can be introduced into and removed from said rotatable drum when the loading door is opened, said connection member having an opening for inlet of air from the interior of said drum.

5. A machine as claimed in claim 4 wherein said connection member is an annular member of S - shaped cross-section.

6. A machine as claimed in claim 4 wherein said connection member has one end secured to the fixed component and an opposite end forming said door frame, said connection member having an inner wall provided with said opening for inlet of air from the interior of said drum and an outer wall with an opening for discharge of the air.

7. A machine as claimed in claim 6 comprising means connected to said opening in the outer wall of said connection member for discharging the air externally of the casing.

8. A machine as claimed in claim 7 wherein said means for discharging the air externally of the casing commprises an extractor turbine, and an exhaust chamber coupled to said opening in the outer wall of said connecting member and to said turbine.

9. A machine as claimed in claim 8 comprising a water pump connected to said fixed component for discharge of water therein and a motor connected to said pump and to said turbine in driving relation.

* * * * *